US011289290B2

(12) United States Patent
Einschenk et al.

(10) Patent No.: US 11,289,290 B2
(45) Date of Patent: Mar. 29, 2022

(54) ADJUSTING DEVICE AND METHOD FOR ADJUSTING SWITCHING DEVICE MECHANISMS

(71) Applicant: Siemens Aktiengesellschaft, Munich (DE)

(72) Inventors: Juergen Einschenk, Panketal (DE); Thomas Knabe, Berlin (DE); Philipp Last, Berlin (DE); Sandro Koehler, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 17/049,089

(22) PCT Filed: Mar. 20, 2019

(86) PCT No.: PCT/EP2019/056954
§ 371 (c)(1),
(2) Date: Oct. 20, 2020

(87) PCT Pub. No.: WO2019/201539
PCT Pub. Date: Oct. 24, 2019

(65) Prior Publication Data

US 2021/0241986 A1 Aug. 5, 2021

(30) Foreign Application Priority Data

Apr. 20, 2018 (DE) ..... 102018206166.1

(51) Int. Cl.
*H01H 33/42* (2006.01)
*H01H 33/666* (2006.01)

(52) U.S. Cl.
CPC ..... *H01H 33/42* (2013.01); *H01H 33/666* (2013.01)

(58) Field of Classification Search
CPC ..... H01H 33/42; H01H 33/44; H01H 33/666; H01H 3/42; H01H 3/38; H01H 2003/323;
(Continued)

(56) References Cited

U.S. PATENT DOCUMENTS 3,784,774 A * 1/1974 Wilson ..... H01H 33/666 218/140
4,064,383 A * 12/1977 Barkan ..... H01H 33/666 218/120

(Continued)

FOREIGN PATENT DOCUMENTS

CN 1395660 A 2/2003
CN 1797633 A 7/2006

(Continued)

*Primary Examiner* — William A Bolton
(74) *Attorney, Agent, or Firm* — Laurence A. Greenberg; Werner H. Stemer; Ralph E. Locher

(57) ABSTRACT

An adjusting device adjusts the stroke of a vacuum switching tube and the bias of a contact compression spring of a switching device mechanism, the spring being paired with the vacuum switching tube, for a medium-voltage switch and/or high-voltage switch. The adjusting device can be driven by a switch shaft, the switch shaft is connected to a transmission element via a connection element, and the transmission element can be connected to a movable switch contact of a medium-voltage switch and/or a high-voltage switch. The transmission element is arranged in a rotatable manner and in a laterally movable manner in the connection element along a recess.

14 Claims, 4 Drawing Sheets

(58) Field of Classification Search
CPC ..... H01H 33/6664; H01H 33/662; H01H 2033/6667; H01H 1/50
USPC ..... 218/140, 120, 136, 118; 200/17 R, 200/19.21, 337
See application file for complete search history.

(56) References Cited

U.S. PATENT DOCUMENTS

| | | | | |
|---|---|---|---|---|
| 5,436,414 | A * | 7/1995 | Hodkin | H01H 33/666 200/17 R |
| 7,015,410 | B2 * | 3/2006 | Einschenk | H01H 33/666 218/140 |
| 8,497,446 | B1 | 7/2013 | Glaser | |
| 8,785,797 | B2 * | 7/2014 | Cortinovis | H01H 33/666 200/501 |
| 8,916,790 | B1 * | 12/2014 | Ando | H01H 33/666 218/154 |
| 2005/0016962 | A1 | 1/2005 | Loebner et al. | |
| 2006/0091112 | A1 | 5/2006 | Neveu et al. | |
| 2010/0078300 | A1 * | 4/2010 | Freundt | H01H 3/30 200/337 |

FOREIGN PATENT DOCUMENTS

| | | | |
|---|---|---|---|
| CN | 2929943 | Y | 8/2007 |
| CN | 202650969 | U | 1/2013 |
| CN | 207038430 | U | 2/2018 |
| DE | 3323861 | A1 | 1/1985 |
| EP | 1653492 | A1 | 5/2006 |
| EP | 3346481 | A1 | 7/2018 |
| TW | 200847206 | A | 12/2008 |

* cited by examiner

ADJUSTING DEVICE AND METHOD FOR ADJUSTING SWITCHING DEVICE MECHANISMS

BACKGROUND OF THE INVENTION

Field of the Invention

The invention relates to an adjusting device for adjusting the stroke of a vacuum switching tube and the bias of a contact pressure spring which is assigned to the vacuum switching tube, to a switching system, or to a switching apparatus having such an adjusting device, and to a method for adjusting the stroke of a vacuum switching tube and the bias of a contact pressure spring which is assigned to the vacuum switching tube.

The assembly and production of switching apparatus mechanisms for vacuum switching tubes is associated with tolerances which arise in the processes.

These tolerances to some extend lead to impermissible deviations arising in the mechanical characteristic values such as, for example, speeds, angular settings.

These impermissible deviations can to some extent be alleviated by various adjustments.

To this end, two methods are in particular known in the prior art.

In the switched-off position "OFF" in which the contacts of the respective assigned vacuum switching tube are not electrically connected, either the detent in this position is varied simultaneously for all terminals and the stroke is thus adjusted for all terminals, or the tube stroke by members of variable length is adjusted individually for each individual terminal. An adjustment is thus performed by a one-time longitudinal variation of members of variable lengths, wherein said members of variable length have a constant length when in operation, thus are not varied when in operation. The contact force of the contact system of the vacuum switching tube is conjointly varied when the stroke is adjusted. The contact force herein typically drops when the stroke is enlarged, that is to say when the spacing of the contacts of the vacuum switching tube is enlarged in the switched-off position "OFF" of the switching apparatus mechanism.

This results from the contact pressure spring in the switched-on position "ON" of the switching apparatus mechanism not being as intensely compressed when switching on by way of an enlarged stroke, said contact pressure spring correspondingly pressing on the contacts of the vacuum switching tube by way of less force.

SUMMARY OF THE INVENTION

It is an object of the invention to alleviate the disadvantages of the prior art and to provide a cost-effective and simpler and more powerful alternative.

The object is achieved by the independent claim 1 and by the dependent claims thereof.

An exemplary embodiment relates to an adjusting device for adjusting a stroke of a vacuum switching tube and a bias of a contact pressure spring of a switching apparatus mechanism for medium-voltage switches and/or high-voltage switches, said contact pressure spring being assigned to the vacuum switching tube, wherein the adjusting device is able to be driven by way of a switch shaft, the switch shaft by way of a connection element is connected to a transmission element, and the transition element is able to be connected to a movable switch contact of a medium-voltage switch and/or high-voltage switch, where in the transmission element is rotatable and disposed so as to be laterally displaceable along a recess in the connection element, and a contact pressure spring is disposed on the connection element in such a manner that the contact pressure spring acts on a laterally displaceable end of the transmission element, and the displaceable end of the transition element in a switched-off position assumes a first terminal position, and in a switched-on position assumes a second terminal position, and the displaceable end by a switching process of the switching apparatus mechanism is able to be transferred from the first terminal position to the second terminal position and/or from the second terminal position to the first terminal position, wherein a readjustable detent acts on the displaceable end of the transmission element in such a manner that a readjustment of the readjustable detent causes a displacement of a first terminal position and thus a variation of the stroke of the vacuum switching tube and of the bias of the contact pressure spring which is assigned to the vacuum switching tube.

This arrangement of the readjustable detent has the effect that the bias of the contact pressure spring which is assigned to the vacuum switching tube is indeed varied simultaneously with the stroke, but the contact pressure, thus the pressure by way of which the contacts of the vacuum switching tube in the switched-on position of the switching apparatus mechanism are pressed onto one another by the contact pressure spring, is not simultaneously varied.

It is preferable for the readjustable detent to be formed by an eccentric or displaceable elongate detent element. The eccentric, or the displaceable elongate detent element, or the recess, can in particular have a graduation which offers an indication pertaining to the effect of the readjustment direction and the quantitative effect of the readjustment.

It is also preferable for the eccentric to have a non-structured face for adjusting in the stepless manner the stroke of the vacuum switching tube and the bias of the contact pressure spring which is assigned to the vacuum switching tube.

It is also preferable for the eccentric to have a structured face for adjusting in a stepped manner the stroke of the vacuum switching tube and the bias of the contact pressure spring which is assigned to the vacuum switching tube. In other words, the end face of the eccentric has a structured face which enables the stroke of the vacuum switching tube and the bias of the contact pressure spring which is assigned to the vacuum switching tube to be adjusted in a stepped manner.

It is also preferable for the structured face of the eccentric to be configured as a crown gear.

It is furthermore preferable for the eccentric to have a non-structured face for adjusting in a stepless manner and a structured face for adjusting in a stepped manner the stroke of the vacuum switching tube and the bias of the contact pressure spring which is assigned to the vacuum switching tube. This has the advantage that standard adjustments in the form of the stepped embodiment, as well as other adjustments in the form of the non-structured, thus unstructured, face are enabled while using one eccentric.

It is also preferable for the readjustable detent by locking means to be fastened in such a manner that the readjustable detent is not able to be readjusted without releasing the locking means.

It is also preferable for the locking means to be formed by a peg and/or a screw, and/or for the locking means to be formed by a peg and/or a screw which in addition to a central point of rotation of the readjustable detent is disposed eccentrically on the readjustable detent.

It is furthermore preferable for the contact pressure spring to be formed by way of a compression spring and/or a tension spring.

It is also preferable for the readjustable detent (280) to be provided with a graduation which correlates with an adjustment position of the stroke or of the variation of the stroke of the vacuum switching tube (2). In other words, the readjustable detent is provided with a graduation which renders the adjustment position identifiable without having to measure the stroke of the vacuum switching tube.

Another exemplary embodiment relates to a switching system having one or more vacuum switching tubes and an adjusting device according to one or a plurality of the preceding embodiments.

A further exemplary embodiment relates to a switching apparatus having one or more vacuum switching tubes and an adjusting device according to one or a plurality of the preceding embodiments.

Another exemplary embodiment relates to a method for simultaneously adjusting a stroke of a vacuum switching tube and a bias of a contact pressure spring of a switching apparatus mechanism for medium-voltage switches and/or high-voltage switches, said contact pressure spring being assigned to the vacuum switching tube, wherein an adjusting device is able to be driven by way of a switch shaft, the switch shaft by way of a connection element is connected to a transmission element, and the transmission element is able to be connected to a movable switch contact of a medium-voltage switch and/or high-voltage switch, wherein the transmission element is rotatable and disposed so as to be laterally displaceable along a recess in the connection element, and a contact compression spring is disposed on the connection element in such a manner that the contact pressure spring acts on a laterally displaceable end of the transmission element, and the displaceable end of the transmission element in a switched-off position assumes a first terminal position, and in a switched-on position assumes a second terminal position, and the displaceable end by a switching process of the switching apparatus mechanism is able to be transferred from the first terminal position to the second terminal position and/or from the second terminal position to the first terminal position, wherein a readjustable detent is adjusted to act on the displaceable end of the transmission element in such a manner that a readjustment of the readjustable detent causes a displacement of a first terminal position and thus a variation of the stroke of the vacuum switching tube and of the bias of a contact pressure spring which is assigned to the vacuum switching tube.

It is preferable herein for the readjustable detent to be adjusted when the switching apparatus mechanism of the adjusting device is situated in the switched-on position and/or is secured in the switched-off position.

Alternatively, it is preferable for the readjustable detent to be adjusted when the switching apparatus mechanism of the adjusting device is situated in the switched-off position and/or is secured in the switched-off position. The adjustment of the detent in this configuration takes place counter to the biased contact pressure spring, thus not without applying force.

It is in particular preferable for the adjustment of the readjustable detent to take place without applying force.

This has the advantage that a more precise adjustment is possible since the effort in terms of force for adjusting the readjustable detent and thus of the switching apparatus mechanism is negligible.

DETAILED DESCRIPTION OF THE INVENTION

Figure 1:
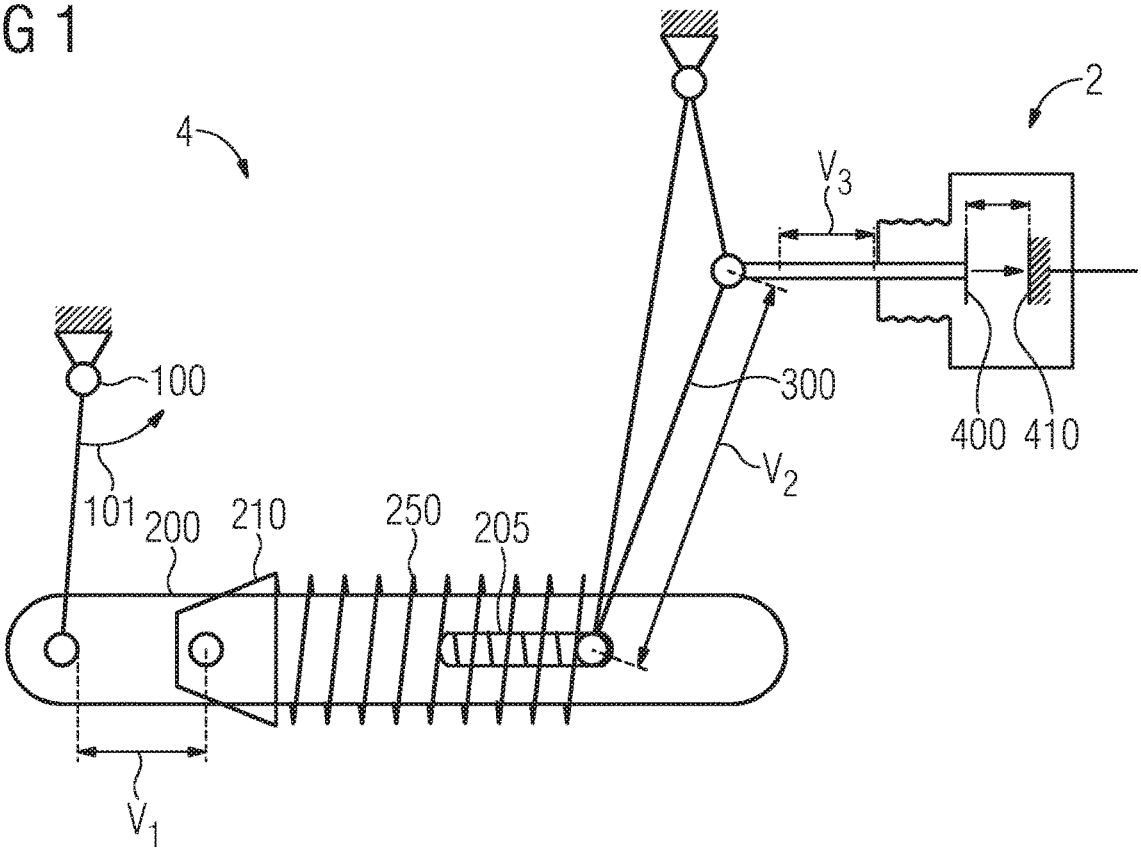
FIG. 1: shows a schematic illustration of a switching kinematics of a vacuum switching tube from the prior art.

FIG. 1 shows a conventional switching kinematics 4 for a vacuum switching tube 2. The vacuum switching tube 2 possesses a fixed contact 410 and a moving contact 400. The moving contact 400 is movable by way of the switching kinematics 4. The switching kinematics 4 is driven by way of a switch shaft 100, and the switching movement is transmitted to the moving contact 400 by way of a connection element 200, having a contact pressure spring 250, and a transmission element 300. A first contact pressure guide 210, which can also be described as a contact pressure detent, holds the contact pressure spring 250 securely on the connection element 200. The connection element 200 furthermore possesses a recess 205 in which one end of the transmission element 300 is movably disposed, and the contact pressure spring 250 acting on the end of the transmission element 300.

The switching kinematics 4 of FIG. 1 possesses three readjustable longitudinal elements, the latter being the first readjustable longitudinal element $V_1$, the second readjustable longitudinal element $V_2$, and the third readjustable longitudinal element $V_3$. Only one of the readjustable longitudinal elements $V_1$, $V_2$, $V_3$ is typically provided per terminal or per switching kinematics.

The contact force of the contact system of the vacuum switching tube 2, composed of the moving contact 400 and the fixed contact 410, is conjointly varied when adjusting the stroke by way of one or a plurality of the readjustable longitudinal elements $V_1$, $V_2$, $V_3$. The contact force herein typically drops when the stroke is enlarged, that is to say when the spacing of the contacts of the vacuum switching tube 2 are enlarged in a switched-off position "OFF" of the switching kinematics 4. The arrow 101 points in the direction of the switching-on movement, that is to say that the switch shaft 100 in this case is rotated in a counterclockwise manner in order to reach a switched-on position of the switching kinematics 4 from a switched-off position of the switching kinematics 4.

Figure 2:
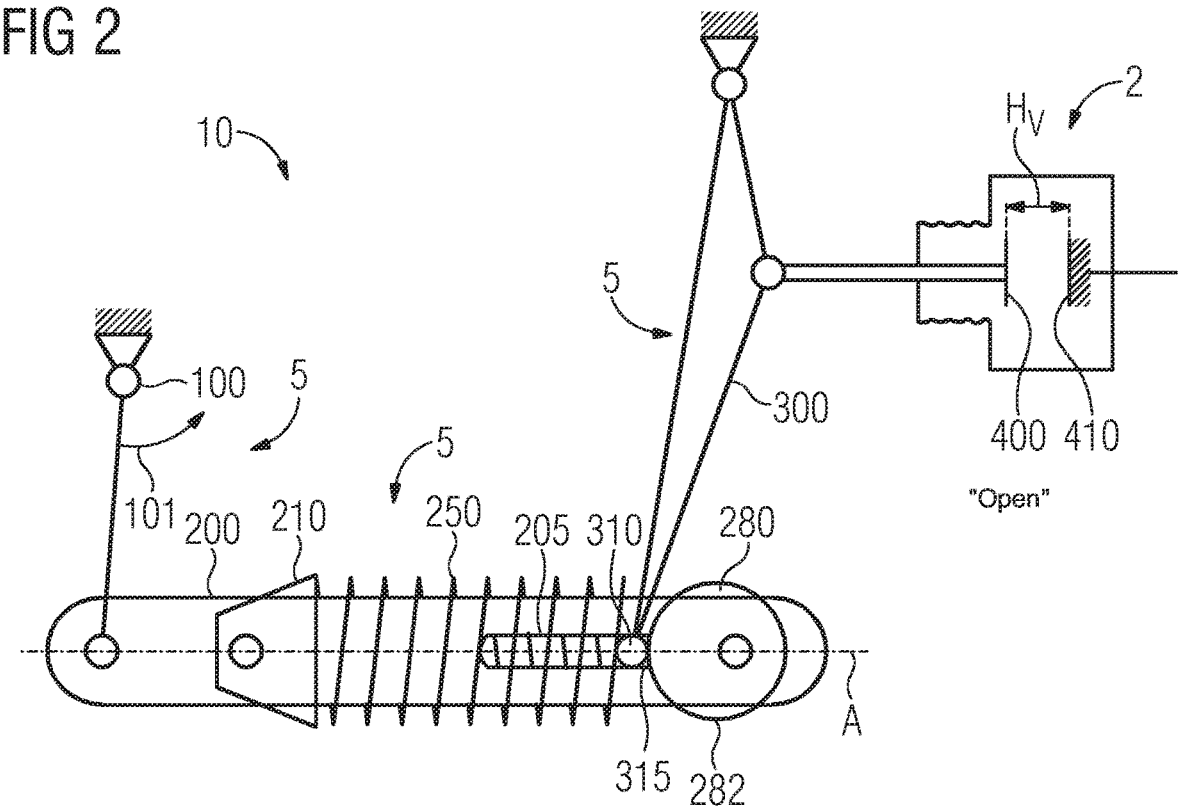
FIG. 2: shows a schematic illustration of an adjusting device according to the invention for adjusting the stroke of a vacuum switching tube and the bias of a contact pressure spring of a switching apparatus mechanism, said contact pressure spring being assigned to the vacuum switching tube.

FIG. 2 shows a schematic illustration of an adjusting device 10 according to the invention for adjusting the stroke $H_V$ of a vacuum switching tube 2 and the bias of a contact pressure spring 250 of a switching apparatus mechanism 5, said contact pressure spring 250 being assigned to the vacuum switching tube 2.

The vacuum switching tube 2 possesses a fixed contact 410 and a moving contact 400. The moving contact 400 is movable by way of the switching apparatus mechanism 5. The switching apparatus mechanism 5 is driven by way of a switch shaft 100, and the switching movement is transmitted to the moving contact 400 by way of a connection element 200, having a contact pressure spring 250, and a transmission element 300. A first contact pressure spring guide 210 holds the contact pressure spring 250 securely on the connection element 200. The connection element 200 furthermore possesses a recess 205, a displaceable end 310 of the transmission element 300 being movably disposed in the recess, and the contact pressure spring 250 acting on the displaceable end 310 of the transmission element 300.

The arrow 101 points in the direction of the switching-on movement, this is to say that switch shaft 100 in this case is rotated in a counterclockwise manner in order to reach a switched-on position of the switching apparatus mechanism 5 from a switched-off position OFF of the switching apparatus mechanism 5.

The switching apparatus mechanism 5 furthermore has a readjustable detent 280 which here is embodied in the form of an eccentric 282. The readjustable detent 280 in the switched-off position OFF determines a first terminal position 315 of the displaceable end 310 of the transmission element 300. A variation of this first terminal position 315 by the readjustable detent 280 causes a variation of the stroke $H_V$ of the vacuum switching tube 2, but not a variation of the contact force of the contact system, composed of the moving contact 410 and the fixed contact 400, of the vacuum switching tube 2 in the switched-on position ON. The recess 205 of the connection element 200 here is elongate in the direction of the axis A of the connection element 200. A stepless readjustment of the first terminal position 315 of the transmission element 300 is possible by way of the eccentric 282, this leading to a fine adjustment capability of the stroke $H_V$ of the vacuum switching tube 2.

Figure 3:
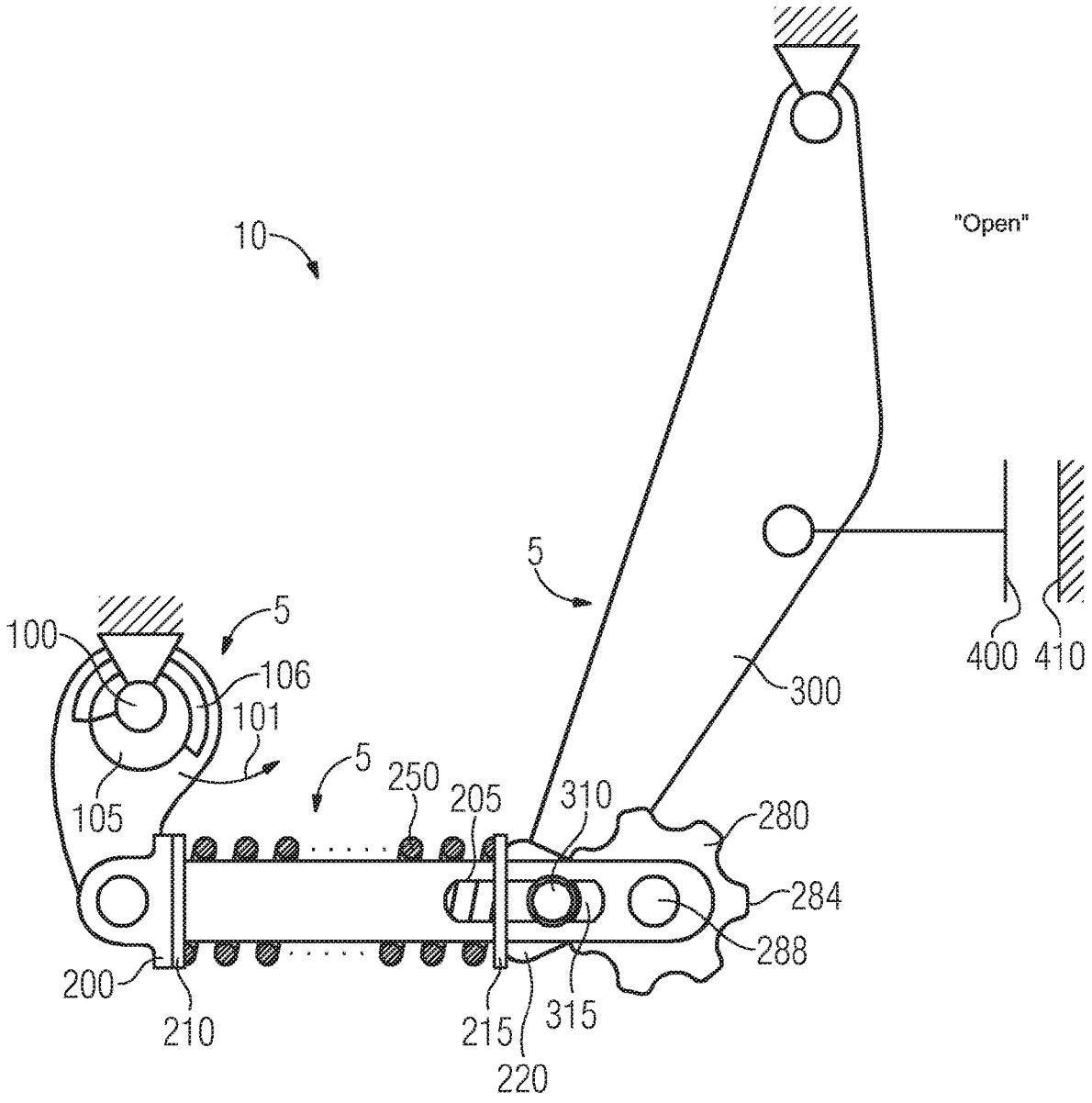
FIG. 3: shows a schematic illustration of an adjusting device according to the invention in the switched-off position "OFF"

FIG. 3 shows a schematic illustration of an adjusting device 10 according to the invention for adjusting in a stepped manner the stroke HV of a vacuum switching tube 2 and the bias of a contact pressure spring 250 of the switching apparatus mechanism 5 in a switched-off position OFF, said contact pressure spring 250 being assigned to the vacuum switching tube 2.

The vacuum switching tube 2 which is not illustrated here possesses a fixed contact 410 and a moving contact 400. The moving contact 400 is movable by way of the switching apparatus mechanism 5. The switching apparatus mechanism 5 is driven by way of a switch shaft 100, and the switching movement is transmitted to the moving contact 400 by way of a connection element 200, having a contact pressure spring 250, and a transmission element 300. A first contact pressure spring guide 210 and a second contact pressure spring guide 215, the latter also being able to be described as a contact pressure spring detent, hold the contact pressure spring 250 securely on the connection element 200. Additionally, a third contact pressure spring guide 220, which can also be described as a cam, ensures an optimal transmission of force from the contact pressure spring 250 to a displaceable end 310 of the transmission element 300. The connection element 200 furthermore possesses a recess 205, the displaceable end 310 of the transmission element 300 being movably disposed in the recess, and the contact pressure spring 250 acting on the displaceable end 310 of the transmission element 300.

The arrow 101 points in the direction of the switching-on movement, that is to say that the switch shaft 100 in this case is rotated in a counterclockwise manner in order to reach a switched-on position of the switching apparatus mechanism 5 from a switched-off position OFF of the switching apparatus mechanism 5. The intermediate element which is disposed between the switch shaft 100 and the connection element 200 furthermore has a position indicator 105 and a position graduation 106 which enable the switch position to be derived without having to see the switch contacts. The switch contacts 400, 410 are separated in the position of FIG. 3, the switch and the switch apparatus mechanism 5 being in the switched-off position "OFF".

The switching apparatus mechanism 5 furthermore has a readjustable detent 280 which here is embodied in the form of an eccentric 284 having a structured face for the adjustment in a stepped manner. The readjustable detent 280 in the switched-off position OFF determines a first terminal position 315 of the displaceable end 310 of the transmission element 300. A variation of this first terminal position 315 by the readjustable detent 280 causes a variation of the stroke $H_V$ of the vacuum switching tube 2 but not a variation of the contact force of the contact system, composed of the moving contact 410 and the fixed contact 400, of the vacuum switching tube 2.

The structured face of the eccentric 284 for the adjustment in a stepped manner enables the first terminal position 315 of the transmission element 300 to be readjusted in a stepped manner, this leading to an adjustment capability of the stroke $H_V$ of the vacuum switching tube 2 in predefined steps.

The readjustable detent 280 optionally possesses a locking means 288, for example a screw, so as to prevent any unintentional readjustment of the readjustable detent 280.

Figure 4:
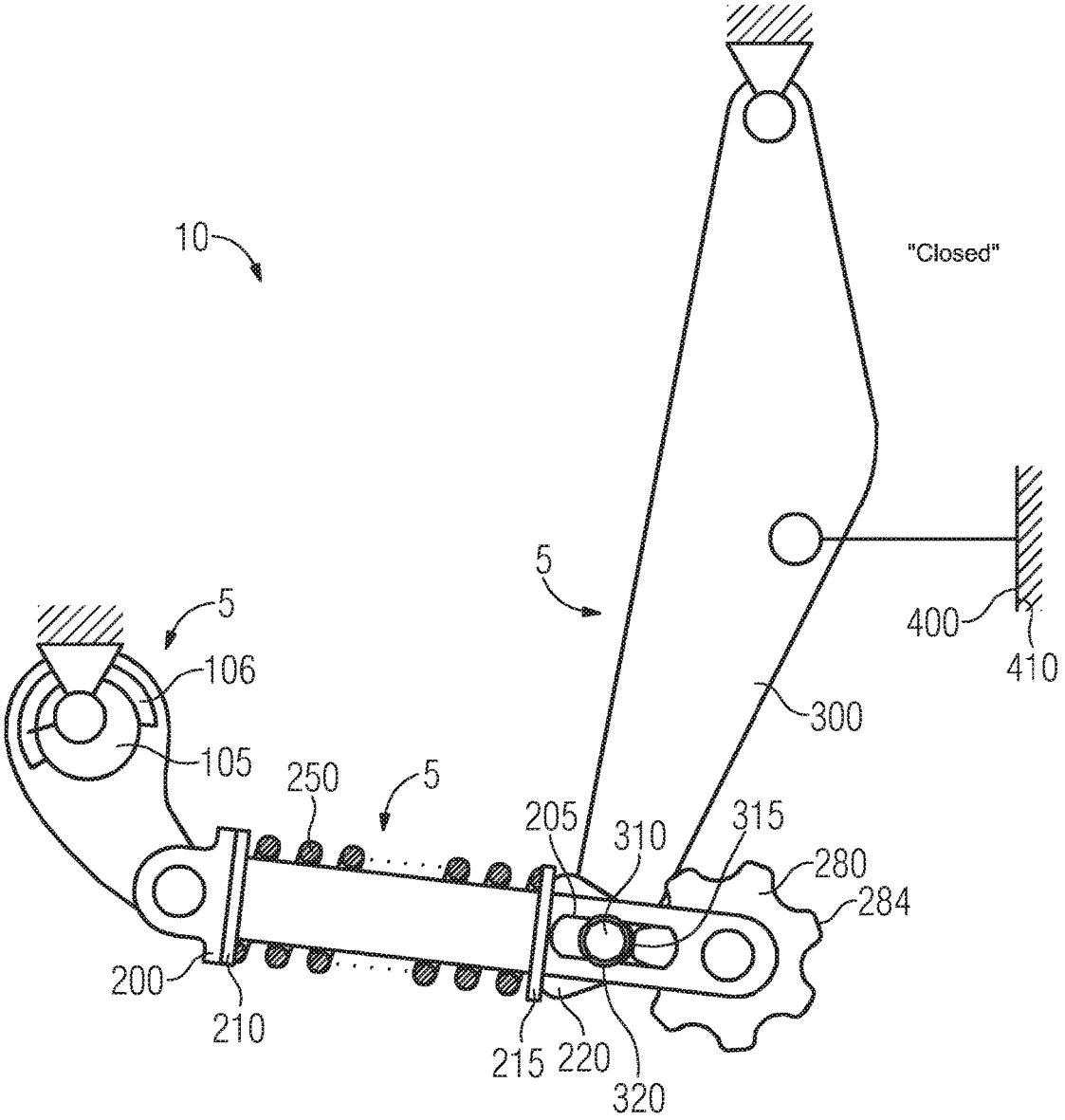
FIG. 4: shows a schematic illustration of an adjusting device according to the invention in the switched-on position "ON"

FIG. 4 shows a schematic illustration of the adjusting device 10 according to the invention from FIG. 3 in the switched-on position "ON".

The intermediate element disposed between the switch shaft 100 and the connection element 200 has a position indicator 105 and a position graduation 106 which enable the switch position to be derived without having to see the switch contacts. The switch contacts 400, 410 in the position of FIG. 4 are in contact, the switch and the switch apparatus mechanism 5 being in the switched-on position "ON".

The adjusting device 10 for adjusting in a stepped manner the stroke $H_V$ of a vacuum switching tube 2 and the bias of a contact pressure spring 250 of the switching apparatus mechanism 5, said contact pressure spring 250 being assigned to a vacuum switching tube 2 not illustrated, is thus illustrated in the switched-on position ON.

The vacuum switching tube 2 which is not illustrated here possesses a fixed contact 410 and a moving contact 400. The moving contact 400 is movable by way of a switching apparatus mechanism 5. The switching apparatus mechanism 5 is driven by way of a switch shaft 100, and the switching movement is transmitted to the moving contact 400 by way of a connection element 200, having a contact pressure spring 250, and a transmission element 300. A first contact pressure spring guide 210 and a second contact pressure spring guide 215 hold the contact pressure spring 250 securely on the connection element 200. Additionally, a third contact pressure spring guide 220 ensures an optimal transmission of force from the contact pressure spring 250 to a displaceable end 310 of the transmission element 300. The connection element 200 furthermore possesses a recess 205, the displaceable end 310 of the transmission element 300 being movably disposed in the recess, and the contact pressure spring 250 acting on the displaceable end 310 of the transmission element 300.

The switching apparatus mechanism 5 furthermore has a readjustable detent 280 which here is embodied in the form of an eccentric 284 having a structured face for adjusting in a stepped manner. The readjustable detent 280 in the switched-off possession OFF determines a first terminal position 315 of the displaceable end 310 of the transmission element 300. In contrast, the displaceable end 310 of the transmission element 300 in FIG. 4 is situated in a second terminal position 320 in which the displaceable end 310 of the transmission element 300 does not exert any force on the readjustable detent 280. A variation of the first terminal position 315 by the readjustable detent 280 in the second terminal position 320 is possible without applying force and causes a variation of the stroke $H_V$ of the vacuum switching tube 2, but not a variation of the contact force of the contact system, composed of the moving contact 410 and the fixed contact 400, of the vacuum switching tube 2.

The structured face of the eccentric 284 for adjusting in a stepped manner enables the first terminal position 315 of the transmission element 300 to be readjusted in a stepped manner, this leading to an adjustment capability of the stroke $H_V$ of the vacuum switching tube 2 in predefined steps.

Figure 5:
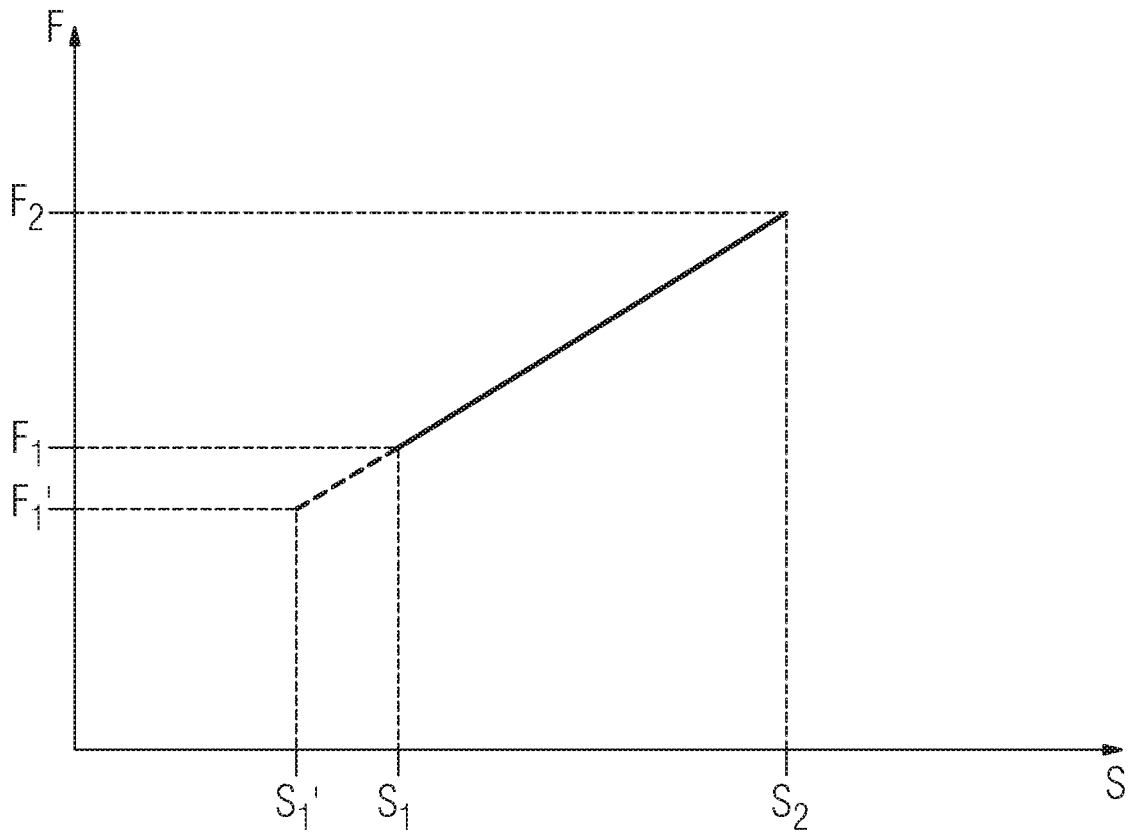
FIG. 5: shows a schematic graphic representation of the correlation between the spring force F and the spring position S.

FIG. 5 shows a schematic graphical representation of the correlation between the spring force F and the spring position S. A first spring position $S_1$ is assumed in the switched-off position OFF from FIG. 2 or FIG. 3. A second spring position $S_2$ is assumed in the switched-on position ON. The first spring force $F_1$ in the first spring position $S_1$ is less than the second spring force $F_2$ in the second spring position $S_2$.

The first spring position $S_1$ can be readjusted to the first spring position $S_1'$ by the readjustable detent 280, wherein the first spring force $F_1$ is indeed varied toward the first spring force $F_1'$, but the second spring force $F_2$ remains the same in the switched-on position.

LIST OF REFERENCE SIGNS

2 Vacuum switching tube;
4 Switching kinematics;
5 Switching apparatus mechanism;
10 Adjusting device;
100 Switching shaft;
101 Arrow in the direction of the switching-on movement;
105 Position indicator;
106 Position graduation;
200 Connection element;
205 Recess, in particular slot, in the connection element 200;
210 First contact pressure spring guide or contact pressure spring detent for the contact pressure spring 250;
215 Second contact pressure spring guide or contact pressure spring detent for the contact pressure spring 250;
220 Third contact pressure spring guide or cam for the contact pressure spring 250;
250 Contact pressure spring;
280 Readjustable detent;
282 Eccentric having a non-structured face for adjusting in a stepless manner;
284 Eccentric having a structured face for adjusting in a stepped manner;
288 Locking means;
300 Transmission element;
310 Displaceable end of the transmission element 300;
315 First terminal position;
320 Second terminal position;
400 Moving contact of the vacuum switching tube 5;
410 Fixed contact of the vacuum switching tube 5; Axis, longitudinal axis of the connection element 200;
$H_V$ Stroke of the vacuum switching tube;
$H_K$ Stroke of the contact pressure spring 250;
$V_1$ First readjustable longitudinal element;
$V_2$ Second readjustable longitudinal element;
$V_3$ Third readjustable longitudinal element;
ON Switched-on position of the switching apparatus mechanism 5;
OFF Switched-off position of the switching apparatus mechanism 5;

The invention claimed is:

1. An adjusting device tor adjusting a stroke of a vacuum switching tube and a bias of a contact pressure spring for medium-voltage switches and/or high-voltage switches, the adjusting device being driven by way of a switch shaft, the adjusting device comprising:

a switching apparatus mechanism having said contact pressure spring, a transmission element and a connection element with a recess formed therein, said contact pressure spring being assigned to the vacuum switching tube, the switch shaft by way of said connection element is connected to said transmission element, and said transmission element is able to be connected to a movable switch contact of a medium-voltage switch and/or a high-voltage switch, said transmission element is rotatable and disposed so as to be laterally displaceable along said recess in said connection element, said contact pressure spring is disposed on said connection element in such a manner that said contact pressure spring acts on a laterally displaceable end of said transmission element, said laterally displaceable end of said transmission element in a switched-off position assumes a first terminal position, and in a switched-on position assumes a second terminal position, said laterally displaceable end by a switching process of said switching apparatus mechanism is able to be transferred from the first terminal position to the second terminal position and/or from the second terminal position to the first terminal position; and said switching apparatus mechanism further having a readjustable detent acting on said laterally displaceable end of said transmission element in such a manner that a readjustment of said readjustable detent causes a displacement of the first terminal position and thus a variation of a stroke of the vacuum switching tube and of the bias of said contact pressure spring which is assigned to the vacuum switching tube.

2. The adjusting device according to claim 1, wherein said readjustable detent is formed by an eccentric or a displaceable elongate detent element.

3. The adjusting device according to claim 2, wherein said eccentric has a non-structured face for adjusting in a stepless manner the stroke of the vacuum switching tube and the bias of said contact pressure spring which is assigned to the vacuum switching tube.

4. The adjusting device according, to claim 2, wherein said eccentric has a structured face for adjusting in a stepped manner the stroke of the vacuum switching tube and the bias of said contact pressure spring which is assigned to the vacuum switching tube.

5. The adjusting device according to claim 4, wherein said the structured face of said eccentric is configured as a crown gear.

6. The adjusting device according to claim 2, wherein said eccentric has a non-structured face for adjusting in a stepless manner and a structured face for adjusting in a stepped manner the stroke of the vacuum switching tube and the bias of said contact pressure spring which is assigned to the vacuum switching tube.

7. The adjusting device according to claim 1, further comprising a locking means, said readjustable detent by said locking means is fastened in such a manner that said readjustable detent is not able to be readjusted without releasing said locking means.

8. The adjusting device according to claim 7, wherein:

said locking means is formed by a peg and/or a screw; and/or said locking means is formed by said peg and/or said screw which in addition to a central point of rotation of said readjustable detent is disposed eccentrically on said readjustable detent.

9. The adjusting device according to claim 1, wherein said contact pressure spring is formed by way of a compression spring and/or a tension spring.

10. The adjusting device according to claim 1, wherein said readjustable detent is provided with a graduation which correlates with an adjustment position of the stroke or of a variation of the stroke of the vacuum switching tube.

11. A switching system, comprising:

at least one vacuum switching tube; and the adjusting device according to claim 1.

12. A method for simultaneously adjusting a stroke of a vacuum switching tube and a bias of a contact pressure spring of a switching apparatus mechanism for medium-voltage switches and/or high-voltage switches, the contact pressure spring being assigned to the vacuum switching tube, which comprises the steps of:

driving an adjusting device by way of a switch shaft, the switch shaft by way of a connection element is connected to a transmission element, and the transmission element is able to be connected to a movable switch contact of a medium-voltage switch and/or a high-voltage switch, wherein the transmission element is rotatable and disposed so as to be laterally displaceable along a recess in the connection element, and the contact pressure spring is disposed on the connection element in such a manner that the contact pressure spring acts on a laterally displaceable end of the transmission element, and the laterally displaceable end of the transmission element in a switched-off position assumes a first terminal position, and in a switched-on position assures a second terminal position, and the laterally displaceable end by a switching process of the switching apparatus mechanism is able to be transferred from the first terminal position to the second terminal position and/or from the second terminal position to the first terminal position; and adjusting a readjustable detent to act on the laterally displaceable end of the transmission element in such a manner that a readjustment of the readjustable detent causes a displacement of the first terminal position and thus a variation of the stroke of the vacuum switching tube and of the bias of a contact pressure spring which is assigned to the vacuum switching tube.

13. The method according to claim 12, wherein the readjustable detent is adjusted when the switching apparatus mechanism of the adjusting device is situated in the switched-on position and/or is secured in the switched-on position, or the readjustable detent is adjusted when the switching apparatus mechanism of the adjusting device is situated in the switched-off position and the adjustment of the readjustable detent takes place counter to the biased contact pressure spring.

14. The method according to claim 13, wherein the adjustment of the readjustable detent takes place without applying force.

* * * * *